US005253787A

United States Patent [19]

Wilkinson et al.

[11] Patent Number: 5,253,787

[45] Date of Patent: Oct. 19, 1993

[54] FLUID DISPENSER WITH TILTABLE DISPENSING NOZZLE AND SEALING MEMBRANE

[75] Inventors: William T. Wilkinson, Crownsville, Md.; John J. Nelson, Levitown, Pa.

[73] Assignee: Package Research Corporation, Cleveland, Ohio

[21] Appl. No.: 924,285

[22] Filed: Aug. 3, 1992

[51] Int. Cl.[5] ..... B67D 5/42

[52] U.S. Cl. ..... 222/209; 222/386

[58] Field of Search ..... 222/206, 207, 209, 212, 222/386, 391

[56] References Cited

U.S. PATENT DOCUMENTS

| | | | |
|---|---|---|---|
| 3,066,833 | 12/1962 | Hershenson | 222/209 |
| 3,788,528 | 1/1974 | Ogle | 222/209 |
| 3,870,200 | 3/1975 | Spatz | 222/206 |
| 4,154,371 | 5/1979 | Kolaczinski | 222/212 |
| 4,474,313 | 10/1984 | Sieverding | 222/405 X |
| 4,830,227 | 5/1989 | Ball et al. | 222/209 X |
| 4,836,423 | 6/1989 | Hayes et al. | 222/383 X |
| 4,949,876 | 8/1990 | Schneider | 222/209 |
| 4,962,870 | 10/1990 | Schneider | 222/209 X |
| 4,991,744 | 2/1991 | von Schuckmann | 222/207 |
| 5,104,009 | 4/1992 | Battegazzore | 222/209 |

*Primary Examiner*—Kevin P. Shaver

*Attorney, Agent, or Firm*—Connolly & Hutz

[57] ABSTRACT

A dispenser for a fluid substance, such as toothpaste, includes an elongated tube having an open top and an open bottom with a chamber therebetween for holding the substance. A bottom closure is mounted to the open bottom to close the open bottom. The bottom closure is longitudinally movable in a sealing manner in the open bottom to press against the substance and to move into the chamber as the substance is being dispensed. A flexible membrane sealing closes the open top of the tube. A nozzle extends through the membrane having a longitudinal passageway communicating with the chamber for dispensing the substance when the nozzle is moved to a dispensing orientation. The membrane is made of a stretchable resilient material so that the nozzle may be titled to the dispensing orientation and thereby stretch the membrane and force the membrane into the chamber to reduce the size of the chamber and cause a portion of the substance to flow through the nozzle.

14 Claims, 1 Drawing Sheet

FLUID DISPENSER WITH TILTABLE DISPENSING NOZZLE AND SEALING MEMBRANE

BACKGROUND OF THE INVENTION

The present invention is directed to fluid dispensers. More particularly, the invention is directed to dispensing fluids such as gel type materials and more particularly to such gel type materials as toothpaste. With such dispensers it is desirable if a dispensing action can be easily accomplished by the user without complicated manipulations. It is particularly desirable if the dispensing could be done in a metered amount. For example, where the fluid is toothpaste, the metered amount would correspond to the amount necessary for applying the proper amount of toothpaste on the brush without dispensing excessive or insufficient toothpaste from the dispenser.

SUMMARY OF THE INVENTION

An object of this invention is to provide a fluid dispenser particularly adaptable for dispensing gel like materials, such as toothpaste.

A further object of this invention is to provide such a dispenser which dispenses a metered amount of fluid substance from the dispenser.

In accordance with this invention the dispenser is in the form of an elongated tube having an open top and open bottom with the chamber therebetween for holding a fluid substance. A bottom closure is mounted to the bottom to thereby close the bottom of the tube. The bottom closure is mounted in such a manner as to be sealingly movable in an axial direction into the chamber as the substance is dispensed from the tube. A flexible membrane sealingly closes the open top of the tube. A nozzle extends through the membrane and has a longitudinal passageway that communicates with the chamber for dispensing the substance from the chamber when the nozzle is moved to a dispensing orientation. The membrane is made of a stretchable resilient material so that the nozzle may be tilted from its normally straight or axial position to the dispensing orientation: When tilted to this orientation the membrane is stretched and pushed into the chamber thereby forcing a metered portion of the substance through the nozzle passageway for being dispensed.

In a preferred practice of the invention the bottom closure is in the form of a spring biased piston which is drawn inwardly to the chamber by the negative pressure created when a metered amount of substance is dispensed.

In the preferred practice of this invention the membrane extends over the peripheral edge of the upper portion of the tube and is locked to the tube by a retainer member which has an inwardly directed peripheral wall. The membrane is held in place by a plate mounted over the membrane with the membrane being sandwiched between the plate and a shoulder on the nozzle. The plate is disposed for contacting the inward directed portion of the retainer when the nozzle is tilted so that the plate acts as a pivot member pivoting against the retainer at one portion of the plate with the diametrically opposite portion of the plate being rotated into the chamber thereby reducing the size of the chamber and forcing the substance to flow through the nozzle.

THE DRAWINGS

DETAILED DESCRIPTION

Figure 1:
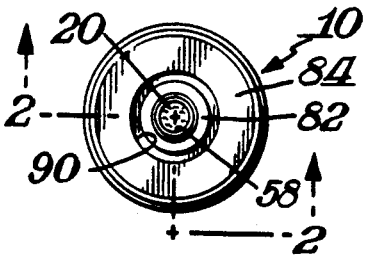
FIG. 1 is a top plan view of a fluid dispenser in accordance with this invention.

The present invention is directed to a fluid dispenser which may be used for dispensing metered amounts of a flowable substance fluid. The invention will be described as a toothpaste dispenser which dispenses toothpaste or gel. It is to be understood, however, that the fluid substance is not limited to these specific materials.

As shown in the drawings the dispenser 10 includes a tube 12 made from any suitable material such as a stiff shape retaining plastic. Tube 12 has an open top 14 and an open bottom 16 with a dispensing chamber 18 therebetween in which the fluid substance 20 is placed in any suitable known manner.

A bottom closure 22 is provided to sealingly close the bottom 16 of tube 12. Bottom closure 22 is intended to move longitudinally within the tube and press against the fluid substance as the amount of fluid substance is reduced in chamber 18. Thus the location of bottom closure 22 would contribute to controlling the size or capacity of chamber 18.

Figure 2:
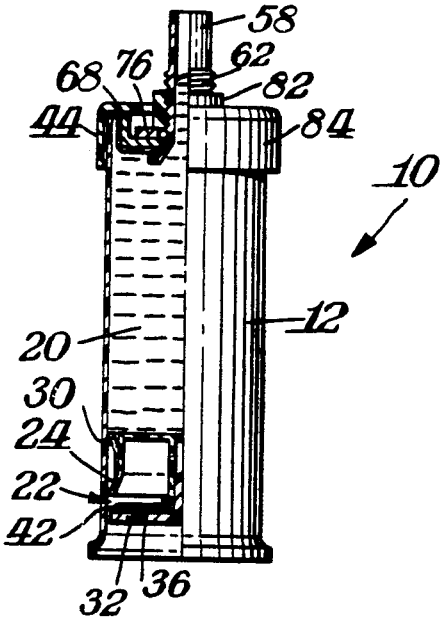
FIG. 2 is a cross-sectional view taken through FIG. 1 along the line 2—2.
Figure 5:
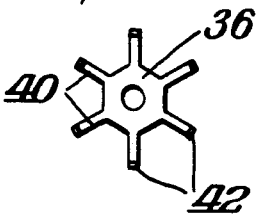
FIG. 5 is a top plan view of the spring used in the dispenser of FIGS. 1–4.
Figure 4:
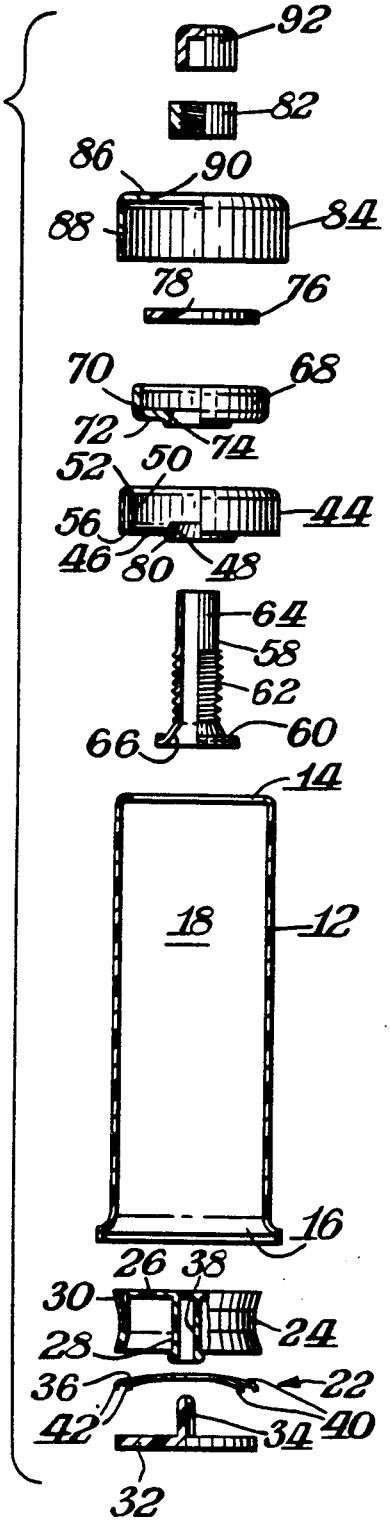
FIG. 4 is an assembly view of the components used in the dispenser of FIGS. 1–2.

Bottom closure 22 is preferably in the form of a piston 24 having a flat head 26 with a hollow stem 28 and a peripheral side wall 30. A cover member 32 has an axial extension 34 for fitting in the axial opening of hollow stem 28. A spring 36 is disposed between cover 32 and piston 24. As best shown in FIG. 2 spring 36 is trapped between cover 32 and the enlarged peripheral flange 38 on stem 28. As shown in FIGS. 2, 4 and 5 spring 36 includes a plurality of spring fingers 40 terminating in downwardly bent ends 42. Ends 42 press against the inner surface of tube 12 to prevent an outward axial movement of bottom closure 22 while permitting closure 22 to move axially inwardly toward open top 14.

Figure 3:
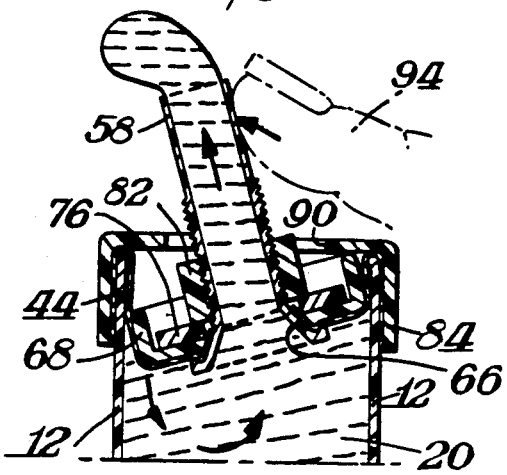
FIG. 3 is an enlarged view of a portion of the dispenser shown in FIGS. 1–2 in its dispensing position.

The top 14 of tube 12 is closed by an assembly which includes a membrane 44. As best shown in FIG. 3 membrane 44 has a generally planar central wall 46 with an axial opening 48. A vertical wall 50 extends upwardly from horizontal wall 46 wall 50 merges into a peripheral shoulder 52 which then merges into an annular vertical wall 54 having a channel 56 between vertical walls 50 and 54. Membrane 44 is disposed over the top edge of tube 12 with the shoulder 52 resting on the edge of tube 12. Vertical wall 54 is disposed outside of tube 12 and vertical wall 50 is disposed inside of tube 12.

A nozzle 58 is inserted through opening 48 of membrane 44. Nozzle 58 includes an outwardly directed peripheral flange or shoulder 60 which is disposed against the lower surface of horizontal wall 46 of membrane 44 so that nozzle 58 can not be pulled through opening 48. Nozzle 58 is provided with a threaded portion 62 and a smooth portion 64. Additionally, nozzle 58 includes an axial passageway 66 which communicates with chamber 18 as best shown in FIGS. 2–3.

A plate 68 is mounted over nozzle 58 against membrane 48. Plate 68 includes an upward peripheral wall 70 and a horizontal central wall 72 with an axial opening 74. Opening 74 is dimensioned to permit plate 68 to be mounted over nozzle 58 with wall 72 of plate 68 disposed against horizontal wall 46 of membrane 44 and with vertical wall 70 of plate 68 disposed against a portion of vertical wall 50 of membrane 44.

A washer 76 having an axial opening 78 is mounted over nozzle 58 and rests against the inner extension 80 of membrane 44.

The various components are locked to nozzle 58 by a nut 82 which is inserted over smooth portion 64 of nozzle 58 and then threadably engaged with threaded portion 62.

The retainer 84 in the form of a cap like member having an inner horizontal wall 86 a downward peripheral skirt 88 and an annular central opening 90 is also utilized in device 10. As shown therein retainer 84 is mounted over tube 12 to trap the outer wall 54 of membrane 44 against the outer surface of tube 12.

FIG. 4 also illustrates a cap 92 which would be mounted over nozzle 58 to close the nozzle during periods of non-use. For the sake of illustration cap 92 is shown only in FIG. 4 and not in FIGS. 1-2.

One of the key features of the invention is that membrane 44 is made from a material which is capable of being stretched and which is resilient to return to its original unstretched condition. Any suitable rubber or plastic material may be used.

FIG. 2 illustrates the static condition of dispenser 10 during periods of non-use. As shown therein nozzle 58 is in a straight position coaxial with the axis of tube 12. Piston 24 is located in the bottom of tube 12 with its system head 26 disposed against the fluid 20 to define the lower end of chamber 18. The upper end of chamber 18 is defined by membrane 44 and nozzle 58 since some of the fluid substance, such as toothpaste 20, would flow into nozzle 58.

FIG. 3 illustrates the condition of dispenser 10 during a dispensing operation. As shown therein the nozzle 58 is tilted or moved to the side by pressure from the user's finger 94. This sidewards motion causes membrane 44 to stretch as the assembly is pivoted against retainer 84 with the edge of plate 44 acting as a lever in its pivotal contact with the inward projecting sidewall 86 of retainer 84. Plate 84 is rotated in a counterclockwise direction. Since membrane 44 is anchored by its coupling with retainer 84 the motion of plate 68 causes the stretching of membrane 44. The downward movement of membrane 44 into chamber 18 reduces the size of chamber 18 and the substance 20 is forced out of the opening or passageway 66 in nozzle 58.

When the nozzle 58 is released the membrane 44 pulls the assembly back to the centered position shown in FIG. 2. This creates a negative pressure within chamber 18. The atmospheric pressure on the outside of tube 12 pushes the piston 24 at the open end 16 of tube 12 longitudinally upwardly and also pushes a small portion of the toothpaste or substance 20 down the nozzle. The spring 36 on closure assembly 22 prevents piston 24 from backing down the tube. In this dispensing operation a metered amount of substance is dispensed from nozzle 58. When the nozzle returns to its normal condition dispenser 10 is ready to dispense another metered amount of substance.

What is claimed is:

1. A dispenser for a fluid substance such as toothpaste comprising an elongated tube having an open top and an open bottom with a chamber therebetween for holding the substance therein, a bottom closure mounted to and closing said open bottom of said tube, said bottom closure being longitudinally movably sealingly mounted in said open bottom of said tube to press against said substance and move into said chamber as said substance is dispensed from said tube, a flexible membrane sealingly closing said open top of said tube, a nozzle separate and distinct from said membrane, said nozzle extending through said membrane, said nozzle having a longitudinal passageway communicating with said chamber for dispensing said substance from said chamber when said nozzle is in a dispensing orientation, said nozzle having a flange below and in contact with said membrane, and said membrane being made of a stretchable resilient material to permit said nozzle to be tilted to said dispensing orientation with a portion of said nozzle flange pressing upwardly against said membrane to prevent said nozzle from completely passing through said membrane so that said tilted nozzle would act to stretch said membrane into said chamber to reduce the size of said chamber and force a metered portion of said substance through said nozzle.

2. The dispenser of claim 1 wherein said bottom closure includes a piston having a piston head mounted against the substance in said chamber, and means for preventing outward movement of said piston within said tube.

3. The dispenser of claim 2 wherein said means for preventing said movement of said piston comprise a spring mounted against the inner surface of said tube, and a cover locking said spring to said piston.

4. The dispenser of claim 3 wherein said membrane extends around the upper edge of said tube at said open top, and retaining means locking said membrane to said tube at said open end.

5. The dispenser of claim 4 wherein said retaining means includes a cap shaped retainer mounted over said open end, said cap shaped retainer having an outer side wall and an annular inwardly directed flange with an axial hole through said flange, said nozzle extending through said axial hole of said retainer, and a portion of said membrane being sandwiched between said side wall of said retainer and the outer surface of said tube.

6. The dispenser of claim 1 wherein said membrane extends around the upper edge of said tube at said open top, and retaining means locking said membrane to said tube at said open end.

7. The dispenser of claim 6 wherein said retaining means includes a cap shaped retainer mounted over said open end, said cap shaped retainer having an outer side wall and an annular inwardly directed flange with an axial hole through said flange, said nozzle extending through said axial hole of said retainer, and a portion of said membrane being sandwiched between said side wall of said retainer and the outer surface of said tube.

8. The dispenser of claim 1 wherein said substance is toothpaste.

9. A dispenser for a fluid substance such as toothpaste comprising an elongated tube having an open top and an open bottom with a chamber therebetween for holding the substance therein, a bottom closure mounted to and closing said open bottom of said tube, said bottom closure being longitudinally movably sealingly mounted in said open bottom of said tube to press against said substance and move into said chamber as said substance is dispensed from said tube, a flexible membrane sealingly closing said open top of said tube, a nozzle extending through said membrane, said nozzle having a longitudinal passageway communicating with said chamber for dispensing said substance from said chamber when said nozzle is in a dispensing orientation, said membrane being made of a stretchable resilient material to permit the nozzle to be tilted to said dispensing orientation to stretch said membrane into said chamber to reduce the size of said chamber and force a metered portion of said substance through said nozzle, said bottom closure including a piston having a piston head mounted against the substance in said chamber, means for preventing outward movement of said piston within said tube, said means for preventing said movement of said piston comprising a spring mounted against the inner surface of said tube, and a cover locking said spring to said piston, said membrane extends around the upper edge of said tube at said open top, retaining means locking said membrane to said tube at said open top, said retaining means including a cap shaped retainer mounted over said open top, said cap shaped retainer having an outer side wall and an annular inwardly directed flange with an axial hole through said flange, said nozzle extending through said axial hole of said retainer, a portion of said membrane being sandwiched between said side wall of said retainer and the outer surface of said tube, a plate mounted around said nozzle with said membrane disposed between said plate and said nozzle, and said plate having a peripheral side wall disposed against said flange of said retainer whereby said plate is pivoted against said flange of said retainer at one location thereof when a tilting force is applied to said nozzle.

10. The dispenser of claim 9 including a washer mounted over said plate with said nozzle extending through said washer, and a nut threadably engaged with said nozzle to lock said washer and said plate and said membrane in place.

11. The dispenser of claim 10 wherein said nozzle includes a annular shoulder at the end of said passageway disposed within said chamber, and said annular shoulder being disposed against said membrane.

12. A dispenser for a fluid substance such as toothpaste comprising an elongated tube having an open top and an open bottom with a chamber therebetween for holding the substance therein, a bottom closure mounted to and closing said open bottom of said tube, said bottom closure being longitudinally movably sealingly mounted in said open bottom of said tube to press against said substance and move into said chamber as said substance is dispensed from said tube, a flexible membrane sealingly closing said open top of said tube, a nozzle extending through said membrane, said nozzle having a longitudinal passageway communicating with said chamber for dispensing said substance from said chamber when said nozzle is in a dispensing orientation, said membrane being made of a stretchable resilient material to permit said nozzle to be tilted to said dispensing orientation to stretch said membrane into said chamber to reduce the size of said chamber and force a metered portion of said substance through said nozzle, said membrane extending around the upper edge of said tube at said open top, retaining means locking said membrane to said tube at said open top, said retaining means including a cap shaped retainer mounted over said open top, said cap shaped retainer having an outer side wall and an annular inwardly directed flange with an axial hole through said flange, said nozzle extending through said axial hole of said retainer, a portion of said membrane being sandwiched between said side wall of said retainer and the outer surface of said tube, a plate mounted around said nozzle with said membrane disposed between said plate and said nozzle, and said plate having a peripheral side wall disposed against said flange of said retainer whereby said plate is pivoted against said flange of said retainer at one location thereof when a tilting force is applied to said nozzle.

13. The dispenser of claim 12 including a washer mounted over said plate with said nozzle extending through said washer, and a nut threadably engaged with said nozzle to lock said washer and said plate and said membrane in place.

14. The dispenser of claim 13 wherein said nozzle includes an annular shoulder at the end of said passageway disposed within said chamber, and said annular shoulder being disposed against said membrane.

* * * * *